United States Patent [19]

Redl

[11] 4,386,621

[45] Jun. 7, 1983

[54] WIND-UP MECHANISM FOR A TILTABLE UMBRELLA

[75] Inventor: Stefan Redl, Midland Park, N.J.

[73] Assignee: Finkel Outdoor Products, Inc., New York, N.Y.

[21] Appl. No.: 371,075

[22] Filed: Apr. 23, 1982

[51] Int. Cl.[3] ..... A45B 17/00

[52] U.S. Cl. ..... 135/20 M; 242/96; 242/118.41

[58] Field of Search ..... 135/20 M; 242/96, 118.41

[56] References Cited

U.S. PATENT DOCUMENTS

| | | | |
|---|---|---|---|
| 2,595,697 | 5/1952 | Pereira | 135/20 M |
| 2,721,569 | 10/1955 | Militano | 135/20 M |
| 3,150,671 | 9/1964 | Frey | 135/20 M |
| 3,434,590 | 3/1969 | Laughlin | 242/118.41 X |
| 3,985,359 | 10/1976 | Moore | 242/118.41 X |
| 4,076,185 | 2/1978 | Dorph | 242/118.41 |

*Primary Examiner*—Harland S. Skogquist
*Attorney, Agent, or Firm*—McAulay, Fields, Fisher, Goldstein & Nissen

[57] ABSTRACT

A wind-up mechanism for a tiltable umbrella is mounted on the umbrella pole for opening the umbrella and then tilting same in response to the winding of respective first and second portions of the same flexible cable. The wind-up mechanism comprises a rotatable wind-up shaft and a wind-up spool connected to the cable and rotatable in response to the rotation of the shaft. The spool comprises first and second axial sections of unequal diameters, with the first axial section being relatively larger for winding the first portion of the cable and the second axial section for winding the second portion of the cable, whereby the wind-up mechanism opens the umbrella at a relatively higher speed than during tilting.

7 Claims, 7 Drawing Figures

WIND-UP MECHANISM FOR A TILTABLE UMBRELLA

BACKGROUND OF THE INVENTION

The present invention relates to a wind-up mechanism for a tiltable umbrella, such as garden, beach, terrace and other such large umbrellas which have the ability to tilt as desired.

In particular, the present invention is directed to an improvement in umbrellas equipped with a wind-up mechanism which is mounted on the umbrella pole for opening the umbrella and then tilting same in response to the winding of respective first and second portions of the same flexible cable. Examples of such umbrella constructions can be found in U.S. Pat. Nos. 2,721,569, 3,142,307, 3,150,671 and 3,175,568. U.S. Pat. No. 2,595,697 shows an alternate type of umbrella assembly wherein two wind-up mechanisms are needed to open and tilt an umbrella.

In this single mechanism type of tiltable umbrella, a crank and gear arrangement is provided which winds a flexible cable on a cylinder. After turning the crank a number of rotations, the umbrella opens to its fully opened state. Further rotation of the crank causes compression of a 200 pound spring, which thereby permits the upper end of the umbrella to tilt in a controlled manner. In order to obtain a sufficient mechanical advantage to compress the spring, the cylinder must be of sufficiently small radius. Unfortunately, this results in an undesirable number of rotations in order to open the umbrella and present constructions require approximately 40 rotations of the crank to open the umbrella.

SUMMARY OF THE INVENTION

The main object of the present invention is to provide a wind-up mechanism for a tiltable umbrella of the type described hereinabove which eliminates the disadvantages of the prior art by providing a wind-up mechanism which opens the umbrella with relatively fewer turns of the wind-up handle, while retaining the mechanical advantage needed during the tilting of the umbrella.

Another object of the present invention is to provide an improved backlash braking mechanism to prevent the unwanted or inadvertent unwinding of the wind-up mechanism after a desired tilt of the umbrella has been achieved.

These and other objects of the present invention are achieved in accordance with the present invention by a wind-up mechanism having a spool which comprises first and second axial sections of unequal diameters, with the first axial section being relatively larger for winding the first portion of the cable which effects the opening of the umbrella and the second axial portion for winding the second portion of the cable for effecting the tilting of the umbrella, whereby the wind-up mechanism opens the umbrella at a relatively higher speed than during tilting.

While a two diameter spool is disclosed in U.S. Pat. No. 4,076,185, such is used with respect to a spinning reel and does not have the same use or function as the spool according to the invention.

In a preferred embodiment of the present invention, the spool further comprises means forming a smooth transition between the first and second axial sections including a linking transition thread between the outer surfaces of the two axial sections. The first axial section preferably comprises a cone frustum gradually tapering away from the second axial section and the cable is connected to the tapered end portion of the first axial section. Further, the spool preferably comprises radially extending flanges at the end portions of each axial section to prevent slippage of the cable.

The spool is preferably enclosed in a substantially cylindrical housing composed of two longitudinal half sections and which has means forming a cylindrical bore at the two ends thereof for receiving umbrella pole sections therein.

The backlash braking mechanism according to the present invention is constituted by a cylindrical shaft which has the spool freely rotatably mounted thereon. At one end of the shaft a first cam member is fixedly attached for rotation with the shaft and is mounted in the housing wall for free rotation therein. At the other end of the shaft, a wind-up handle is fixedly mounted for driving the shaft and between the spool and the handle, a first wheel is disposed for free rotation about the shaft and within a housing wall opposite the first cam member. A ratchet wheel is disposed between the first wheel and the handle for free rotation about the shaft and a ratchet pawl is pivotally mounted on the housing and engaged with the ratchet teeth to prevent rotation of the ratchet wheel in one direction. The spool has a second cylindrical cam member around the shaft and facing the first cam member. The first and second cam members comprise mating pairs of truncated spirals arranged peak to base along the same plane transverse to their axis of rotation. The distance between the handle and the first cam member is less than the sum of the lengths of the ratchet wheel, first wheel, spool and cam rise of the second cam member.

The two speed wind-up mechanism for use with umbrellas imparts a two speed cable winding action with the corresponding variation in mechanical advantage. The spool and cable are enclosed in a split housing which acts as a fully stressed member of the umbrella pole.

In use, the cable is wound around the larger diameter spool at the side furthest the second axial section, in a single layer without overlap. Upon winding over the entire length of the larger diameter axial section, the cable winds smoothly inward onto the smaller diameter section via the decreasing radius transition thread. The smaller radius axial section now provides the increased mechanical advantage for overcoming the spring tension of the tilting mechanism. With the two diameter spool enclosed in a split housing, the housing acts as a fully stressed member of the umbrella pole. The rotation of the spool can be effected by a common type driving shaft which passes through the spool and the spool housing, with the driving shaft attached, outside of the housing, to a wind-up handle with a suitable backlash braking mechanism.

These and other features and advantages of the present invention will be explained in more detail in the following description with reference to the accompanying drawings wherein:

DETAILED DESCRIPTION OF THE INVENTION

It should be noted at the outset that because the present invention is directed to an improvement in the wind-up mechanism for a tiltable umbrella of the type wherein the winding of the same cable effects both the opening and the tilting of the umbrella, applicant hereby incorporates the teachings and the disclosure of U.S. Pat. No. 2,721,569 with regard to the remaining structure of the garden umbrella which can be used in conjunction with the wind-up mechanism according to the present invention to enable one skilled in the art to make and use the invention.

Figure 1:
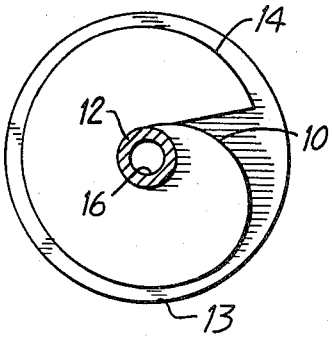
FIG. 1 is a sectional view along line I-I in FIG. 2 of the spool according to the present invention.
Figure 2:
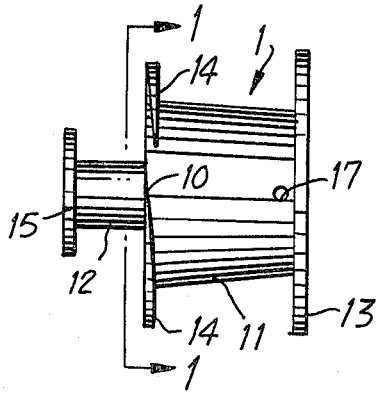
FIG. 2 is a side view of the spool according to the present invention.
Figure 3:
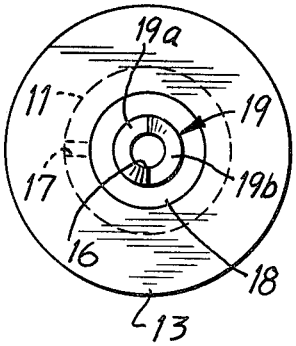
FIG. 3 is an end view of the spool shown in FIG. 2.

Referring to FIGS. 1–3, the spool 1 comprises a first axial section 11 and a second axial section 12 of unequal diameters. Axial section 11 is relatively larger in diameter than section 12 and the outer surface of axial section 11 is preferably formed as a cone frustum which gradually tapers away from axial section 12. The spool 1 has a central bore 16 therein for the mounting of a shaft 3 for effecting rotation of the spool 1.

The external surfaces of the two axial sections 11 and 12 communicate via a transition thread 10 at the point of the juncture between sections 11 and 12. Additionally, axial sections 11 and 12 are bounded by radially extending cable retaining flanges 13, 15 which are located at the ends thereof and partial radially extending flange 14 disposed at the juncture of the two sections 11 and 12. The partial flange 14 extends around the spool except where the transition thread 10 is disposed, at which point the flange 14 is blended down to the frustum outer surface.

In order to connect the flexible cable C to the spool 1, a radial bore 17 is provided at the smallest end of the axial section 11. The bore 17 communicates with axial recess 18 disposed in the end of the spool section 11. Connection of the cord C is accomplished by insertion thereof into bore 17, drawing same out of the recess 18 and knotting same whereby the knot remains enlarged in recess 18 so as not to interfere with the rotation of spool 1.

While the spool 1 is shown with a cylindrical bore 16 for receiving a wind-up shaft, it is clear that the shaft hole may be of other suitable shapes such as square, rectangular, or can be suitably shaped to engage any one of the commonly used techniques for transmitting drives such as by keys, splines, etc. In the embodiment shown in FIGS. 1–3, a cylindrical cam member 19 including cam sections 19*a* and 19*b* are provided for effecting drive transmission in conjunction with a backlash braking mechanism which will be explained hereinafter with respect to FIGS. 5 and 6.

Figure 4:
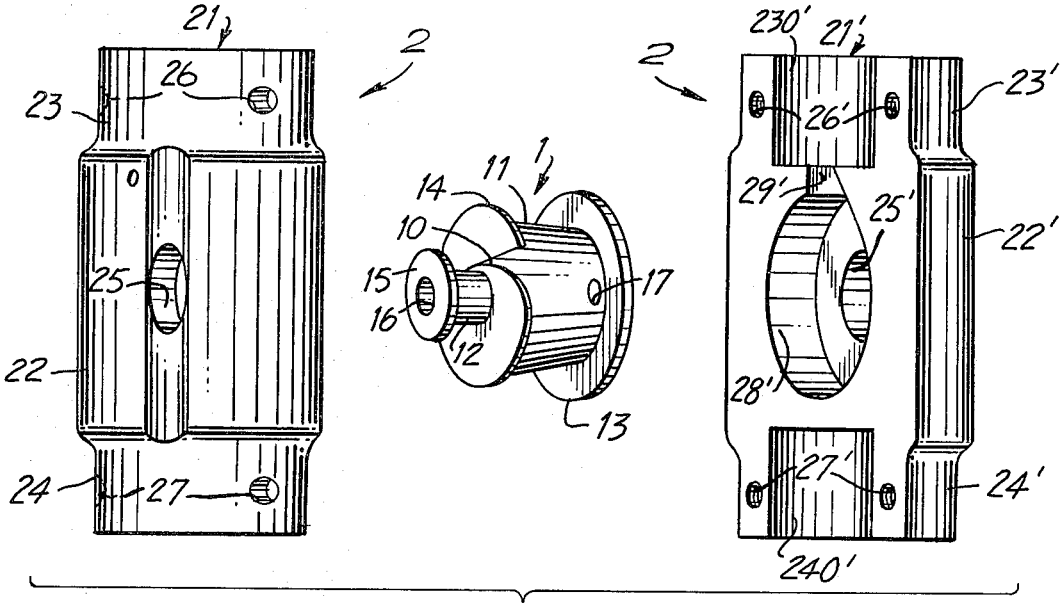
FIG. 4 is an exploded perspective view showing the spool and the housing for the same.
Figure 6:
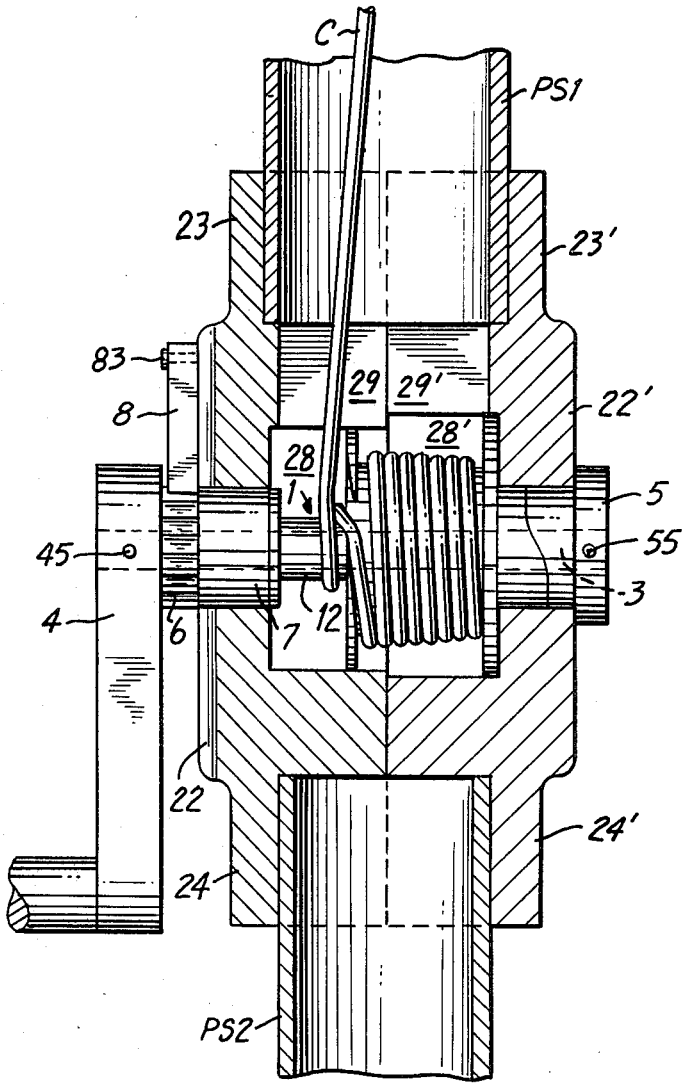
FIG. 6 is a partial section view of the wind-up mechanism assembled in the housing.

Referring now to FIGS. 4 and 6, the spool housing 2 is preferably substantially cylindrical and includes two half sections 21, 21′ which are provided with transverse bores 25, 25′ through which the driving shaft 3 is to be mounted for rotation. The spool housing 2 is additionally provided with means forming umbrella pole securing collars 23, 23′ and 24, 24′ which with recesses 230, 240 (not shown) and 230′, 240′ form hollow cylindrical bores extending axially out of the top and bottom of the body portions 22, 22′ to secure umbrella poles therein. The collars can be provided with any common means of shaft couplings such as pinning, set screws, etc. While the housing is shown being split vertically, it can also be seen that the housing can be split horizontally about the centers of bores 25, 25′.

The portions 23 and 23′ have connecting bores 26, 26′ and sections 24, 24′ have connecting bores 27, 27′ for receiving fastening screws in order to hold the two sections together.

Within the split housing halves 21 and 21′ are provided cylindrical bores 28, 28′ for mounting the spool 1 therein. Moreover, the bores 29, 29′ are provided to define a cable entry slot communicating between the upper pole securing collar space 230, 230′ and the spool mounting space 28, 28′.

Figure 5A:
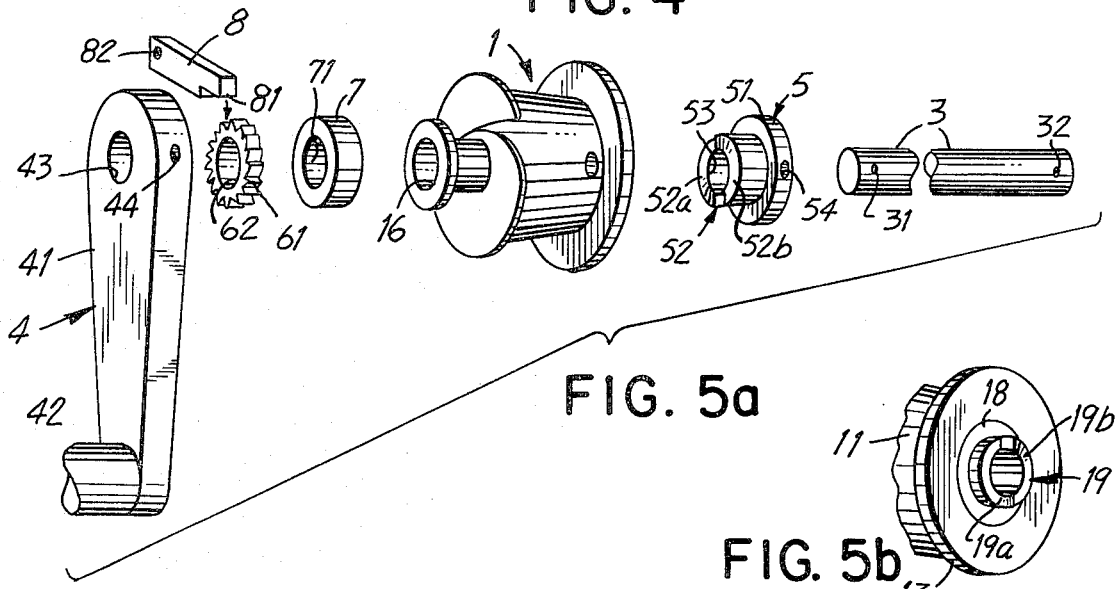
FIG. 5*a* is an exploded perspective view of the complete wind-up mechanism including the anti-backlash mechanism.
Figure 5B:
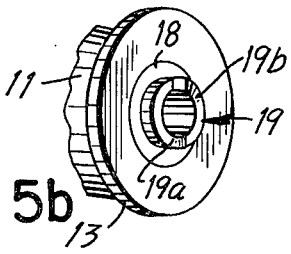
FIG. 5*b* is a partial perspective view the cam member on the spool.

Referring now to FIGS. 5*a*, 5*b* and FIG. 6, the mounting of the spool 1 in housing 2 along with a backlash braking mechanism including members 3–8, is shown.

As explained hereinabove, spool 1 is provided with the axial shaft bore 16 which passes through the entire length thereof and is circular in cross section. Spool 1 receives the axial shaft 3 and is freely rotatably mounted thereon. Thus there is no direct drive transmitted to the spool 1 directly from the shaft 3.

The spool driving and backlash braking functions are carried out by the other members shown in FIGS. 5*a*. This assembly consists of a cam collar 5 having a cylindrical cam thereon with cylindrical cam members 52*a* and 52*b* all of which having a cylindrical bore 53 extending therethrough. The collar portion 51 has a pin hole 54 therein for receiving a pin 55 which is also received in shaft pin hole 32 to fix the member 5 in place on shaft 3. The collar 51 bears against the outside wall of housing member 22′ while the cam portion 52 is received in the wall in bore 25′.

Spacer wheel 7 having axial cylindrical bore 71 is also received on shaft 3 for free rotation therearound and is disposed for free rotation in bore 25 of section 22. Disposed outside of the housing and on shaft 3 is ratchet wheel 6 having ratchet teeth 61 and cylindrical bore 62 configured so as to make the ratchet wheel 6 freely rotatable about shaft 3. A pawl member 8 is pivotally mounted via bore 82 and fastener 83 to the housing portion 22 so that edge 81 engages teeth 61 to permit only clockwise rotation of the ratchet wheel 6.

Attached to the other end of shaft 3 is wind-up handle 4 which has a cylindrical bore 43 therein and pin hole 44 for receiving pin 45 which engages pin hole 31 in shaft 3 to fix the handle 4 thereon. Handle 4 includes a main body portion 41 and a gripping portion 42 to enable the manual winding thereof.

The cam members 19*a*, 19*b* on spool 1 and 52*a*, 52*b* on member 5 are monodirectional end cams which consists of a pair of truncated spirals arranged peak to base along the same plane transverse to the axis of rotation. The cams meet with each other and effect the transmission of force from the handle to the spool and a backlash braking function as a result of the way in which the mechanism is assembled as shown in FIG. 6. As shown, the handle distance fixed by the pins 45, 55 in shaft holes 31 and 32 are fixed so that the distance between handle 4 and the inside edge of collar portion 51 is less than the sum of the lengths of the ratchet wheel 6, the spacer wheel 7, the two axial sections of the spool 1 and twice the cam rise of cams 19 and 52.

In use, upon rotation of the handle 4 in the clockwise direction in order to open the umbrella, the cam members 19 and 52 force themselves apart due to the fact that the spool 1 is initially held stationary by the weight of the umbrella frame and cover acting through the lifting cable C. The rotation of the member 5 due to its direct connection with shaft 3 causes the face of cam 52 to slide upward on the cam spiral 19 of the spool 1.

When the spool is forced firmly against spacer 7, which in turn presses upon the ratchet wheel 6 and handle 4, the entire assembly is locked together by static friction. As a result, drive is transmitted from the handle 4 to the shaft 3 to member 5, while the freely rotatable elements 1, 6 and 7 are driven by the static friction. Upon cessation of the clockwise cranking, the temporarily locked driving-braking assembly is prevented from counterclockwise rotation by the locking action of the pawl 8 on the ratchet teeth 61.

In order to release the mechanism to unwind the umbrella cable, a predetermined counterclockwise force applied at the handle 4 eliminates the static friction effect through reversal of the cam 52 due to the direct drive of handle 4 through shaft 3 on member 5. The counterclockwise sliding of the cam surfaces of cam member 52 and cam member 19 renders the pawl locking action ineffectual due to the fact that the ratchet wheel is freely rotatable about shaft 3. The umbrella can then be lowered by the interlocking of the edges of the cam members which permit direct engagement of cams 19 and 52 in the counterclockwise direction.

As can be seen in FIG. 6, the cable C is wound from the extreme right hand side of spool 1 without overlap. The cable portion wound on axial section 11 corresponds to that portion of the cable which effects the opening of the umbrella. The cable is then directed via the smooth transition formed by the thread 10 to the smaller diameter axial section 12 which then winds the portion of the cable C which corresponds to the tilting of the umbrella. In this way, the mechanical advantage afforded by the section 11 is retained while the speed of opening the umbrella is afforded by the larger diameter axial section 11.

It will be appreciated that the instant specification and claims are set forth by way of illustration and not limitation, and that various modifications and changes may be made without departing from the spirit and scope of the present invention.

What is claimed is:

1. In a tiltable umbrella having a wind-up mechanism mounted on the umbrella pole for opening the umbrella and then tilting same in response to the winding of respective first and second portions of the same flexible cable, the improvement wherein the wind-up mechanism comprises: a rotatable wind-up shaft; a wind-up spool connected to the cable; means for effecting rotation of the spool in response to the rotation of the shaft; and wherein the spool comprises first and second axial sections of unequal diameters, with the first axial section being relatively larger for winding the first portion of the cable and the second axial section for winding the second portion of the cable; whereby the wind-up mechanism opens the umbrella at a relatively higher speed than during tilting.

2. The wind-up mechanism according to claim 1, wherein the spool further comprises means forming a smooth transition between the first and second axial sections including a linking transition thread between the outer surfaces of two axial sections.

3. The wind-up mechanism according to claim 2, wherein the first axial section comprises a cone frustum gradually tapering away from the second axial section and means connecting the cable to the tapered end portion thereof.

4. The wind-up mechanism according to claim 1 or 3, further comprising a substantially cylindrical housing composed of two longitudinal half sections in which the shaft and spool are rotatably mounted and including means forming a cylindrical bore at the two ends thereof for receiving umbrella pole sections therein.

5. The wind-up mechanism according to claim 1, 2 or 3, wherein the shaft is a cylindrical rod and wherein the means for effecting rotation of the spool in response to the rotation of said shaft comprises a housing through which the shaft is disposed transverse to the axis of the umbrella poly with the spool mounted therearound within the housing for free rotation, means rotatably supporting the shaft in the housing comprising a first wheel freely rotatably mounted in one wall of the housing and freely rotatably receiving said shaft and a first cylindrical cam member freely rotatably mounted in the wall of the housing opposite the first wheel and fixed to one end of the shaft for rotation therewith, a wind-up handle disposed outside of the housing and fixed to the other end of the shaft for rotatably driving same, a ratchet wheel freely rotatably mounted on the shaft outside of the housing between the first wheel and the handle, a pole pivotably mounted on the housing and engaging with the ratchet wheel to prevent rotation thereof in one direction, and wherein the spool has a second cylindrical cam member disposed at one end thereof around the shaft and facing the first cam member, wherein the first and second cam members comprise mating pairs of truncated spirals arranged peak to base along the same plane transverse to their axis of rotation and wherein the distance between the handle and the first cam member is less than the sum of the lengths of the ratchet wheel, first wheel, spool and the cam rise of the second cam member.

6. The wind-up mechanism according to claim 5, wherein the housing is substantially cylindrical and composed of two longitudinal half sections including means forming a cylindrical bore at the two ends thereof for receiving umbrella pole sections therein.

7. The wind-up mechanism according to claim 2 or 3, wherein the wind-up spool further comprises radially extending flanges at the end portions of each axial section.

* * * * *